US006476769B1

(12) United States Patent
Lehtola

(10) Patent No.: US 6,476,769 B1
(45) Date of Patent: Nov. 5, 2002

(54) INTERNAL MULTI-BAND ANTENNA

(75) Inventor: Antero Lehtola, Turku (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/956,753

(22) Filed: Sep. 19, 2001

(51) Int. Cl.[7] ..... H01Q 1/24
(52) U.S. Cl. ..... 343/702; 343/700 MS
(58) Field of Search ..... 343/700 MS, 702, 343/846, 848, 876

(56) References Cited

U.S. PATENT DOCUMENTS 6,121,930 A * 9/2000 Grangeat et al. .... 343/700 MS
6,348,892 B1 * 2/2002 Annamaa et al. .... 343/700 MS
6,380,905 B1 * 4/2002 Annamaa et al. .... 343/700 MS
6,407,715 B1 * 6/2002 Chen ..... 343/700 MS
6,408,190 B1 * 6/2002 Ying ..... 343/700 MS

* cited by examiner

*Primary Examiner*—Tan Ho
(74) *Attorney, Agent, or Firm*—Ware, Fressola, Van Der Sluys & Adolphson LLP

(57) ABSTRACT

A radio antenna including a first shorted patch having a first resonance frequency (GSM1800), a second shorted patch connected to the first shorted patch for sharing a first feed point, and a third shorted patch separately having a second feed point. A first switch and a second switch connect between the ground and, respectively, the first and the second feed points. To cause the second and third shorted patches to produce, respectively, a second (E-GSM900) and a third resonance frequency (PCS1900), the first switch is operated in the open position while the second switch is operated in the closed position. To cause the first and third shorted patches to produce, respectively, a third frequency and a fourth resonance frequency (UMTS), the first switch is operated in the closed position while the second switch is operated in the open position.

23 Claims, 3 Drawing Sheets

INTERNAL MULTI-BAND ANTENNA

FIELD OF THE INVENTION

The present invention relates generally to a radio antenna and, more specifically, to an internal multi-band antenna for use in a hand-held telecommunication device, such as a mobile phone.

BACKGROUND OF THE INVENTION

The development of small antennas for mobile phones has recently received much attention due to size reduction of the handsets, requirements to keep the amount of radio-frequency (RF) power absorbed by a user below a certain level regardless of the handset size, and introduction of multi-mode phones. It would be advantageous, desirable and even necessary to provide internal multi-band antennas to be disposed inside a handset body, and these antennas should be capable of operating in multiple systems such as E-GMS900 (880 MHz–960 MHz), GSM1800 (1710 MHz–1880 MHz), PCS1900 (1859 MHz–1990 MHz) and UMTS (1900 MHz–2170 MHz). Shorted patch antennas, or planar inverted-F antennas (PIFAs), have been used to provide two or more resonance frequencies. For example, Liu et al. (Dual-frequency planar inverted-F antenna, IEEE Transaction on Antennas and Propagation, Vol.45, No.10, October 1997, pp. 1451–1458) discloses a dual-band PIFA; Pankinaho (U.S. Pat. No. 6,140,966) discloses a double-resonance antenna structure for several frequency ranges, which can be used as an internal antenna for a mobile phone; Isohatala et al. (EP 0997 970 A1) discloses a planar antenna having a relatively low specific absorption rate (SAR) value; and Song et al. (Triple-band planar inverted-F antenna, IEEE Antennas and Propagation International Symposium Digest, Vol.2, Orlando, Fla., Jul. 11–16, 1999, pp.908–911) discloses a triple-band PIFA. As mobile phones capable of operating at the UMTS frequencies will become a reality in near future, it is advantageous and desirable to provide an antenna structure capable of operating in the UMTS frequencies as well as the GSM frequencies.

SUMMARY OF THE INVENTION

According to first aspect of the present invention, a multi-band radio antenna structure for use in a hand-held telecommunication device comprises:

a ground plane;

a sub-antenna structure comprising:

a first radiating element formed of a first electrically conducting area having a first resonance frequency, wherein the first electrically conducting area has a first end connected to the ground plane for grounding the first radiating element, and wherein the first radiating element has a first feed-point for feeding located adjacent to the first end; and a second radiating element formed of a second electrically conducting area disposed adjacent to the first electrically conducting area, wherein the second electrically conducting area has a second end electrically connected to the first end of the first electrically conducting area for grounding the second radiating element and for sharing the first feed-point for feeding;

a third radiating element formed of a third electrically conducting area adjacent to the sub-antenna structure, wherein the third electrically conducting area has a third end connected to the ground plane for grounding the third radiating element, and wherein the third radiating element has a second feed-point for feeding located adjacent to the third end;

a first switching device, operable either in an open position or in a closed position, connecting between the first feed-point and the ground plane; and a second switching device, operable either in an open position or in a closed position, connecting between the second feed-point and the ground plane, wherein when the second switching device is operated in the closed position, thereby grounding the second feed-point and the first switching device is operated in the open position for enabling the first feed-point feeding, the second radiating element has a second resonance frequency substantially lower than the first resonance frequency and the third radiating element has a third resonance frequency generally higher than the first resonance frequency, and when the first switching device is operated in the closed position, thereby grounding the first feed-point and second switching device is operated in the open position for enabling the second feed-point feeding, the third radiating element has a fourth resonance frequency generally higher than the third resonance frequency.

According to the present invention, when the first switching device is operated in the closed position and the second switching device is operated in the open position, the first radiating element has a fifth resonance frequency substantially equal to the third resonance frequency.

According to the present invention, the first resonance frequency is substantially in a frequency range of 1710 MHz to 1880 MHz, the second resonance frequency is substantially in a frequency range of 880 MHz to 960 MHz, the third resonance frequency is substantially in a frequency range of 1850 MHz to 1990 MHz, and the fourth resonance frequency is substantially in a frequency range of 1920 MHz to 2170 MHz.

According to present invention, the third electrically conducting area is adjacent to the first electrically conducting area or adjacent to the second electrically conducting area.

According to the present invention, the first and the second radiating elements are planar radiating elements located substantially on a common plane.

According to the present invention, the first, second and third radiating elements are planar radiating elements located substantially on a common plane.

According to the present invention, the first, second and third radiating elements are planar radiating elements but some or all of the radiating elements can be folded such that each of the folded radiating elements is located in two or more intersecting planes.

According to the second aspect of the present invention, a method of achieving at least four resonance frequencies in a multi-band antenna structure including:

a ground plane;

a sub-antenna structure comprising:

a first radiating element formed of a first electrically conducting area having a first resonance frequency, wherein the first electrically conducting area has a first end connected to the ground plane for grounding the first radiating element, and wherein the first radiating element has a first feed-point for feeding located adjacent to the first end; and a second radiating element formed of a second electrically conducting area disposed adjacent to the first electrically conducting area, wherein the second electrically conducting area has a second end electrically connected to the first end of the first electrically conducting area for grounding the second radiating element and for sharing the first feed-point for feeding;

a third radiating element formed of a third electrically conducting area adjacent to the sub-antenna structure, wherein the third electrically conducting area has a third end connected to the ground plane for grounding the third radiating element, and wherein the third radiating element has a second feed-point for feeding located adjacent to the third end, said method comprising the steps of:

providing a first switching device, operable either in an open position or in a closed position, connecting between the first feed-point and the ground plane;

providing a second switching device, operable either in an open position or in a closed position, connecting between the second feed-point and the ground plane; and setting the second switching device in the closed position, thereby grounding the second feed-point and the first switching device in the open position for enabling the first feed-point feeding, so as to cause the second radiating element to produce a second resonance frequency substantially lower than the first resonance frequency and the third radiating element to produce a third resonance frequency generally higher than the first resonance frequency, or setting the first switching device in the closed position, thereby grounding the first feed-point and second switching device in the open position for enabling the second feed-point feeding so as to cause the third radiating element to produce a fourth resonance frequency generally higher than the third resonance frequency.

According to the present invention, when the first switching device is set in the closed position and the second switching device is set in the open position, the first radiating element to produce a fifth resonance frequency substantially equal to the third resonance frequency.

The present invention will become apparent upon reading the description taking in conjunction with FIGS. 1 to 3*b*.

DETAILED DESCRIPTION

Figure 1:
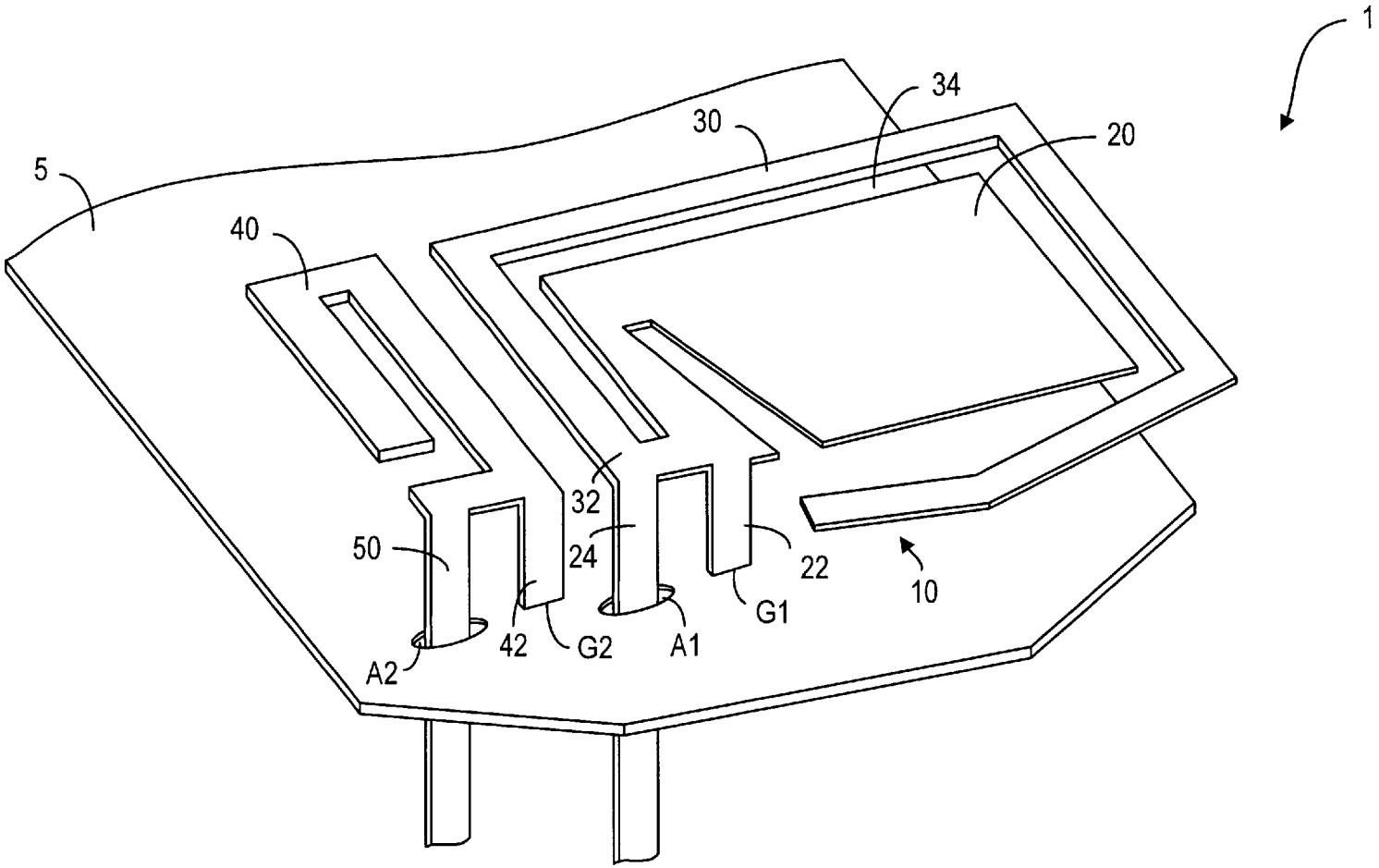
FIG. 1 is an isometric view illustrating the radiating elements of the multi-band antenna structure, according to the preferred embodiment of the present invention.

FIG. 1 shows the radiating elements of the multi-band antenna structure 1, according to the preferred embodiment of the present invention. As shown, the antenna structure 1 has a ground plane 5, a sub-antenna structure 10 having a first radiating element 20, a second radiating element 30 and a third radiating element 40. In the sub-antenna structure 10, the first radiating element 20 is substantially a planar, electrically conducting element having a first end 22 for grounding the first radiating element 20 to the ground plane 5 at a grounding point G1. As such, the first radiating element 20 is a short-circuited patch having a first resonance frequency. Preferably, the first resonance frequency is substantially in the range of 1710 MHz to 1880 MHz. Adjacent to the first end 22, a feed line 24 is provided to the first radiating element 20 for feeding. The second radiating element 30 is substantially a strip of planar electrically conducting area surrounding the first radiating element 20, leaving a gap 34 therebetween. The second radiating element 30 has second end 32, which is connected to first end 22 of the first radiating element 20 for grounding the second radiating element 30. As such, the second radiating element 30 becomes a short-circuited patch and, at the same time, the second radiating element 30 can share the feed line 24 for feeding. The third radiating element 40 is physically separated from the sub-antenna structure 10 except that they are connected through the ground plane 5. As shown, the third radiating element 40 is substantially a planar electrically conducting element having a third end 42 connected to the ground plane 5 for grounding the third radiating element 40 to the ground plane 5 at a ground point G2. As such, the third radiating element 40 is also a short-circuited patch. Adjacent to the third end 42, a feed line 50 is provided to the thrid radiating element 40 for feeding.

As shown in FIG. 1, all the radiating elements 20, 30, 40 are located substantially on a common plane. However, it is possible that only two of the radiation elements 20, 30, 40 are located on the same plane, or each of them is located on a different plane. Furthermore, one or more of these radiating elements can be folded so that each of the folded elements can be located on different planes. The feed lines 24 and 50 are shown to pass through the ground plane 5 via apertures A1 and A2 in order to connect to their respective radio-frequency modules. However, it is not necessary for the feed lines 24 and 50 to pass through the ground plane, as such, to reach the radio-frequency modules.

Figure 2:
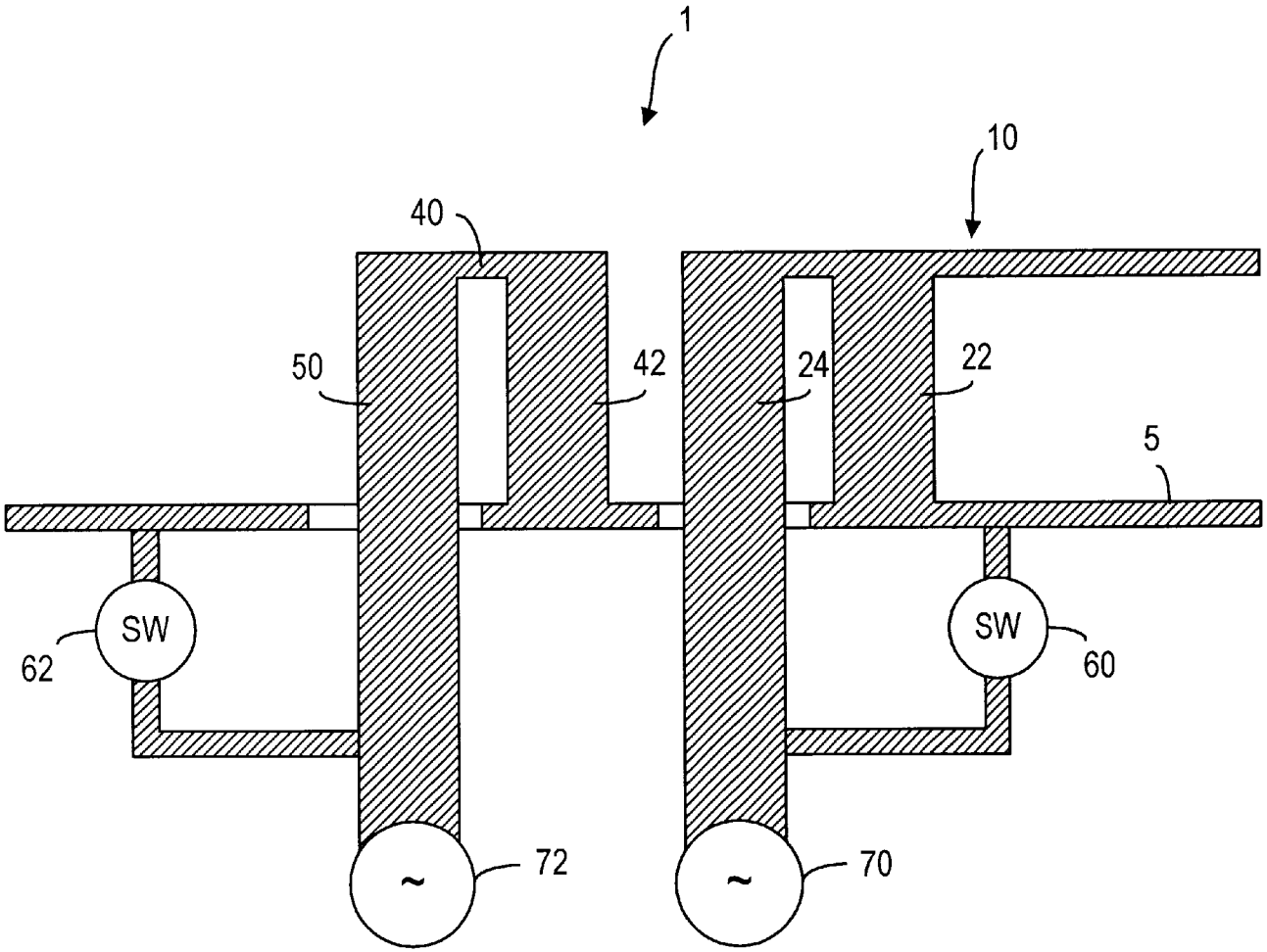
FIG. 2 is a diagrammatic representation illustrating the switching devices connected between the feed points and the ground plane.
Figure 3B:
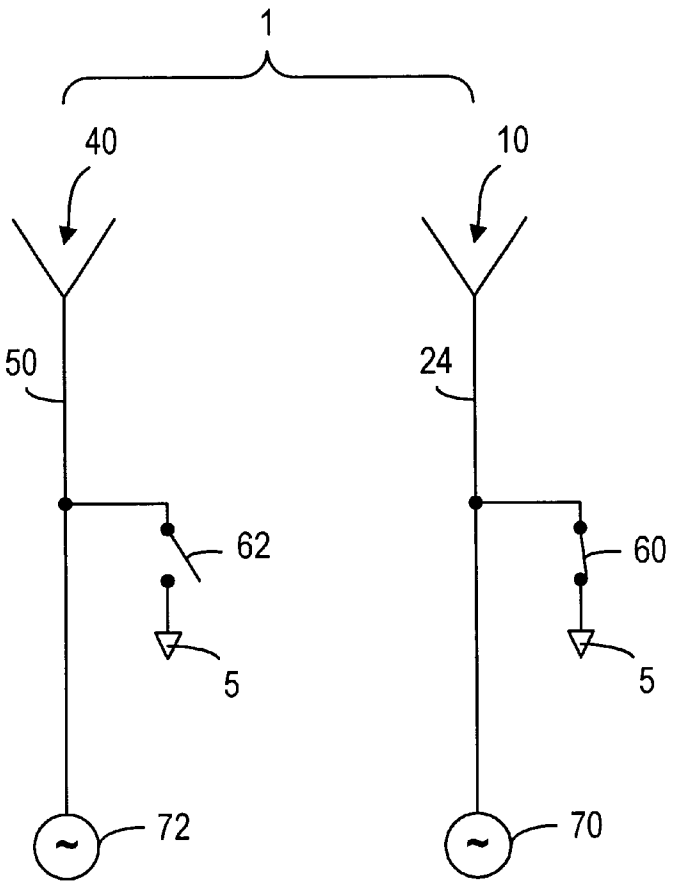
FIG. 3*b* is a diagrammatic representation illustrating another switching configuration of the multi-band antenna structure.
Figure 3A:
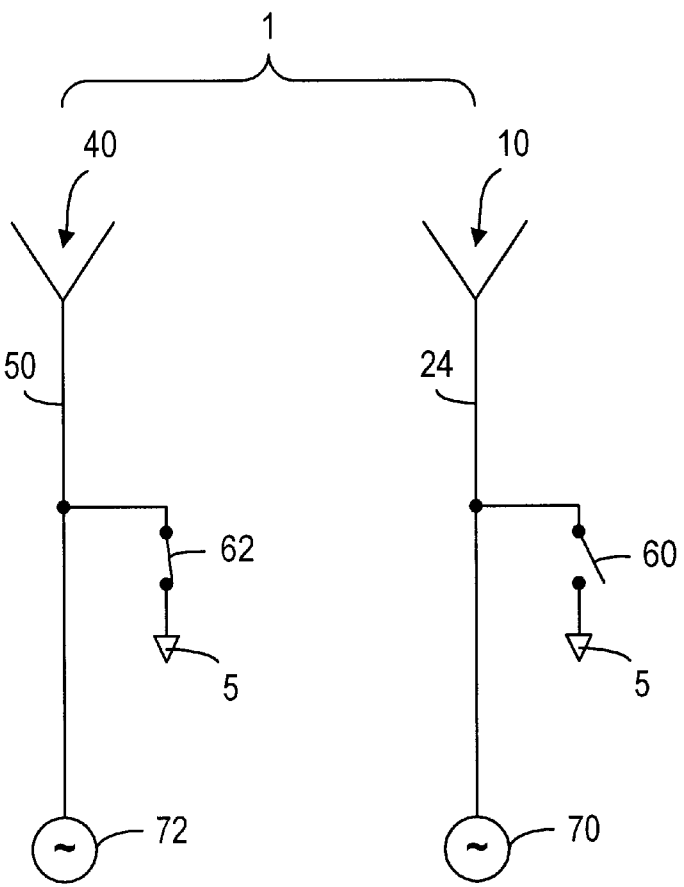
FIG. 3*a* is a diagrammatic representation illustrating one switching configuration of the multi-band antenna structure, according to the present invention.

As shown in FIG. 2, the feed line 24 is connected to a radio-frequency module 70 for feeding while the feed line 50 is connected to a radio-frequency module 72 for feeding. A switching device 60 is connected between the feed line 24 and the ground plane 5 and a switching device 62 is connected between the feed line 50 and the ground plane 5. Each of the switching devices 60, 62 is operable either in an open position or a closed position. As shown in FIG. 3*a*, the switching device 60 is operated in an open position for enabling the feeding of the feed line 24 between the radio-frequency module 70 and the sub-antenna structure 10, while the switching device 62 is operated in a closed position, thereby grounding the feed line 50 to the ground plane 5. When the switching devices 60, 62 are in these positions, the second radiating element 30 has a second resonance frequency substantially lower than the first resonance frequency, and the third radiating element 40 has a third resonance frequency generally higher than the first frequency. Preferably, the second resonance frequency is substantially in the range of 880 MHz to 960 MHz and the third resonance frequency is substantially in the range of 1850 and 1990 MHz. However, when the switching device 62 is operated in the open position for enabling the feeding of the feed line 50 between the radio-frequency module 72 and the third radiating element 40, and the switching device 60 is operated in a closed position thereby grounding the feed line 24 to the ground plane 5, the third radiating element 40 has a fourth resonance frequency generally higher than the third resonance frequency, and the first radiating element 20 has a fifth resonance frequency substantially equal to the third resonance frequency. Preferably, the fourth resonance frequency is substantially in the range of 1920 MHz to 2170 MHz.

The switch devices 60, 62 can be PIN diodes, FET switches, MEMS (Micro-Electro Mechanical Systems) switches, or other solid-state switches.

According to the preferred embodiment of the present invention, all the electrically conducting areas constituting the radiating elements of the antenna structure can be located on a common plane, but they can be located on different planes. The antenna structure can be made more compact by using narrow strips of electrically conducting areas with meandering patterns in two or three dimensions. Furthermore, it is not necessary that the radiating element 30 surrounds the radiating element 20, as shown in FIG. 1.

The present invention has been disclosed in conjunction with GSM and UMTS frequencies. However, the resonance frequencies can be made higher or lower by changing the size and geometry of the one or more radiating elements. For example, it is possible to use the same antenna as a short range radio link (like Bluetooth) antenna.

The multi-band radio antenna of the present invention can be used in an electronic device such as a mobile phone, a personal digital assistant device, a portable computer or the like.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A multi-band radio antenna structure for use in a hand-held telecommunication device comprising:

a ground plane;

a sub-antenna structure comprising:

a first radiating element formed of a first electrically conducting area having a first resonance frequency, wherein the first electrically conducting area has a first end connected to the ground plane for grounding the first radiating element, and wherein the first radiating element has a first feed-point for feeding located adjacent to the first end; and a second radiating element formed of a second electrically conducting area disposed adjacent to the first electrically conducting area, wherein the second electrically conducting area has a second end electrically connected to the first end of the first electrically conducting area for grounding the second radiating element and for sharing the first feed-point for feeding;

a third radiating element formed of a third electrically conducting area adjacent to the sub-antenna structure, wherein the third electrically conducting area has a third end connected to the ground plane for grounding the third radiating element, and wherein the third radiating element has a second feed-point for feeding located adjacent to the third end;

a first switching device, operable between an open position and a closed position, connecting between the first feed-point and the ground plane; and a second switching device, operable between an open position and a closed position, connecting between the second feed-point and the ground plane, wherein when the second switching device is operated in the closed position, thereby grounding the second feed-point and the first switching device is operated in the open position for enabling the first feed-point feeding, the second radiating element has a second resonance frequency substantially lower than the first resonance frequency and the third radiating element has a third resonance frequency generally higher than the first resonance frequency, and when the first switching device is operated in the closed position, thereby grounding the first feed-point, and the second switching device is operated in the open position for enabling the second feed-point feeding, the third radiating element has a fourth resonance frequency generally higher than the third resonance frequency.

2. The multi-band radio antenna of claim 1, wherein when the first switching device is operated in the closed position and second switching device is operated in the open position, the first radiating element has a fifth resonance frequency substantially equal to the third resonance frequency.

3. The multi-band radio antenna structure of claim 1, wherein the first resonance frequency is substantially in a frequency range of 1710 MHz to 1880 MHz.

4. The multi-band radio antenna structure of claim 1, wherein the second resonance frequency is substantially in a frequency range of 880 MHz to 960 MHz.

5. The multi-band radio antenna structure of claim 1, wherein the third resonance frequency is substantially in a frequency range of 1850 MHz to 1990 MHz.

6. The multi-band radio antenna structure of claim 1, wherein the fourth resonance frequency is substantially in a frequency range of 1920 MHz to 2170 MHz.

7. The multi-band radio antenna structure of claim 1, wherein the third electrically conducting area is adjacent to the first electrically conducting area.

8. The multi-band radio antenna structure of claim 1, wherein the third electrically conducting area is adjacent to the second electrically conducting area.

9. The multi-band radio antenna structure of claim 1, wherein the second electrically conducting area is adjacent to at least two sides of the first electrically conducting area.

10. The multi-band radio antenna structure of claim 1, wherein the second electrically conducting area is adjacent to at least three sides of the first electrically conducting area.

11. The multi-band radio antenna structure of claim 1, wherein the switching devices comprise at least one PIN diode.

12. The multi-band radio antenna structure of claim 1, wherein the switching devices comprise at least one FET switch.

13. The multi-band radio antenna structure of claim 1, wherein the switching devices comprise at least one MEMS switch.

14. The multi-band radio antenna structure of claim 1, wherein the switching devices are solid state switches.

15. The multi-band radio antenna structure of claim 1, wherein the hand-held telecommunication device is a mobile phone.

16. The multi-band radio antenna structure of claim 1, wherein the hand-held telecommunication device is a personal digital assistant device.

17. The multi-band radio antenna structure of claim 1, wherein the hand-held telecommunication device is a portable computer.

18. A method of achieving at least four resonance frequencies in a multi-band antenna structure including:

a ground plane;

a sub-antenna structure comprising:

a first radiating element formed of a first electrically conducting area having a first resonance frequency, wherein the first electrically conducting area has a first end connected to the ground plane for grounding the first radiating element, and wherein the first radiating element has a first feed-point for feeding located adjacent to the first end; and a second radiating element formed of a second electrically conducting area disposed adjacent to the first electrically conducting area, wherein the second electrically conducting area has a second end electrically connected to the first end of the first electrically conducting area for grounding the second radiating element and for sharing the first feed-point for feeding; and a third radiating element formed of a third electrically conducting area adjacent to the sub-antenna structure, wherein the third electrically conducting area has a third end connected to the ground plane for grounding the third radiating element, and wherein the third radiating element has a second feed-point for feeding located adjacent to the third end, said method comprising the steps of:

providing a first switching device, operable between an open position and a closed position, connecting between the first feed-point and the ground plane;

providing a second switching device, operable between an open position and a closed position, connecting between the second feed-point and the ground plane; and setting the second switching device in the closed position, thereby grounding the second feed-point, and the first switching device is in the open position for enabling the first feed-point feeding so as to cause the second radiating element to produce a second resonance frequency substantially lower than the first resonance frequency and the third radiating element to produce a third resonance frequency generally higher than the first resonance frequency, or setting the first switching device in the closed position, thereby grounding the first feed-point, and the second switching device is in the open position for enabling the second feed-point feeding, so as to cause the third radiating element to produce a fourth resonance frequency generally higher than the third resonance frequency.

19. The method of claim 18, wherein when the first switching device is set in the closed position and the second switching device is set in the open position, the first radiating element produces a fifth resonance frequency substantially equal to the third resonance frequency.

20. The method of claim 18, wherein the second resonance frequency is substantially in a frequency range of 880 MHz to 960 MHz.

21. The method of claim 18, wherein the first resonance frequency is substantially in a frequency range of 1710 MHz to 1880 MHz.

22. The method of claim 18, wherein the third resonance frequency is substantially in a frequency range of 1850 MHz to 1990 MHz.

23. The method of claim 18, wherein the fourth resonance frequency is substantially in a frequency range of 1920 MHz to 2170 MHz.

* * * * *

UNITED STATES PATENT AND TRADEMARK OFFICE

CERTIFICATE OF CORRECTION

PATENT NO. : 6,476,769 B2
DATED : November 5, 2002
INVENTOR(S) : Lehtola

It is certified that error appears in the above-identified patent and that said Letters Patent is hereby corrected as shown below:

Column 1,
Line 32, “970” should be -- 974 --.

Column 4,
Line 29, “thrid” should be -- third --.

Signed and Sealed this

Thirteenth Day of May, 2003

JAMES E. ROGAN
*Director of the United States Patent and Trademark Office*